US007851687B2

(12) United States Patent
Chang et al.

(10) Patent No.: US 7,851,687 B2
(45) Date of Patent: Dec. 14, 2010

(54) ILLUMINATED CYMBAL

(76) Inventors: Henry Chang, 606, 3rd Ave., #126, San Diego, CA (US) 92101; Erik Stauber, 3437 Arizona St., San Diego, CA (US) 92104

( * ) Notice: Subject to any disclaimer, the term of this patent is extended or adjusted under 35 U.S.C. 154(b) by 156 days.

(21) Appl. No.: 12/353,469

(22) Filed: Jan. 14, 2009

(65) Prior Publication Data

US 2010/0177516 A1 Jul. 15, 2010

(51) Int. Cl.
*A63J 17/00* (2006.01)

(52) U.S. Cl. ..... 84/464 R; 84/464 A

(58) Field of Classification Search ..... 84/464 R, 84/464 A

See application file for complete search history.

(56) References Cited

U.S. PATENT DOCUMENTS 3,626,458 A * 12/1971 Zickos ..... 84/411 R
4,091,706 A * 5/1978 Ludwig ..... 84/411 R
4,226,163 A * 10/1980 Welcomer ..... 84/422.4
4,563,933 A * 1/1986 Kim ..... 84/267
5,262,585 A * 11/1993 Greene et al. ..... 84/645
5,280,742 A * 1/1994 Vergara ..... 84/411 R
5,509,343 A * 4/1996 Hsu ..... 84/418
5,922,981 A * 7/1999 Ballister ..... 84/464 A
6,423,891 B1 * 7/2002 Zengerle ..... 84/422.4
7,227,075 B2 * 6/2007 Chang et al. ..... 84/645
7,271,328 B2 * 9/2007 Pangrle ..... 84/464 R
7,501,571 B2 * 3/2009 Forsman et al. ..... 84/737
7,525,032 B2 * 4/2009 Mishima ..... 84/477 R
7,667,130 B2 * 2/2010 Mishima ..... 84/723
7,759,569 B2 * 7/2010 Poels ..... 84/422.1
7,763,788 B2 * 7/2010 Wachter ..... 84/411 M
2010/0175542 A1 * 7/2010 Chang et al. ..... 84/645
2010/0177516 A1 * 7/2010 Chang et al. ..... 362/253
2010/0180755 A1 * 7/2010 Copeland et al. ..... 84/622

OTHER PUBLICATIONS

Pintech VisuLite Professional Trigger Cymbals, developed over 10 years ago, viewed Aug. 4, 2010 at http://www.hopedrums.com/visulite_cymbals.htm.*

* cited by examiner

*Primary Examiner*—Jeffrey Donels
*Assistant Examiner*—Robert W Horn
(74) *Attorney, Agent, or Firm*—Gordon & Rees LLP

(57) ABSTRACT

An illuminated cymbal, including: a light transmitting cymbal body; top and bottom coverings on opposite sides of portions of the cymbal body; a light source mounted to emit light into the cymbal body, wherein the light source is positioned such that the light is reflected between the top and bottom coverings to reflect radially outwards through the cymbal body to illuminate the cymbal body; and a striking sensor pad mounted on top of the cymbal body.

10 Claims, 3 Drawing Sheets

10
20
20
20
30
35
33
33
33
40
60
70

ILLUMINATED CYMBAL

TECHNICAL FIELD

The present invention relates to musical instruments, and in particular to cymbals.

SUMMARY OF THE INVENTION

The present invention provides an illuminated cymbal for musical performances. In various optional aspects of the invention, the cymbal may be continuously illuminated, or it may be illuminated only when struck. Other options are also possible. For example, the cymbal may be continuously illuminated with one color, but change color when struck In preferred aspects, the cymbal may either be transparent or translucent. When the cymbal is transparent, a lighting system causes the outer rim of the circular cymbal to appear as a bright visual ring. If the cymbal is instead translucent, its entire body may instead be illuminated.

In one preferred aspect, the present invention provides an illuminated cymbal, comprising: a light transmitting cymbal body; top and bottom coverings on opposite sides of portions of the cymbal body; a light source mounted to emit light into the cymbal body, wherein the light source is positioned such that the light is reflected between the top and bottom coverings to reflect radially outwards through the cymbal body to illuminate the cymbal body; and a striking sensor pad mounted on the cymbal body. Preferably, when the cymbal body is transparent, light is reflected radially outwards through the cymbal body to illuminate an outer edge of the cymbal body.

The light source is preferably an LED mounted into a hole in the bottom covering. One or more fans may also be mounted onto the bottom covering of the cymbal body for cooling the light source. In one embodiment, the LED is mounted to a heat sink, and the heat sink is cooled by the fan(s). A striking sensor pad is mounted onto the top of the light transmitting cymbal body. When a cymbal player strikes the striking sensor pad, the striking sensor produces a signal which is electronically transmitted through a musical control channel to a speaker and heard as a sound of the cymbal being struck.

DETAILED DESCRIPTION OF THE DRAWINGS

Figure 1:
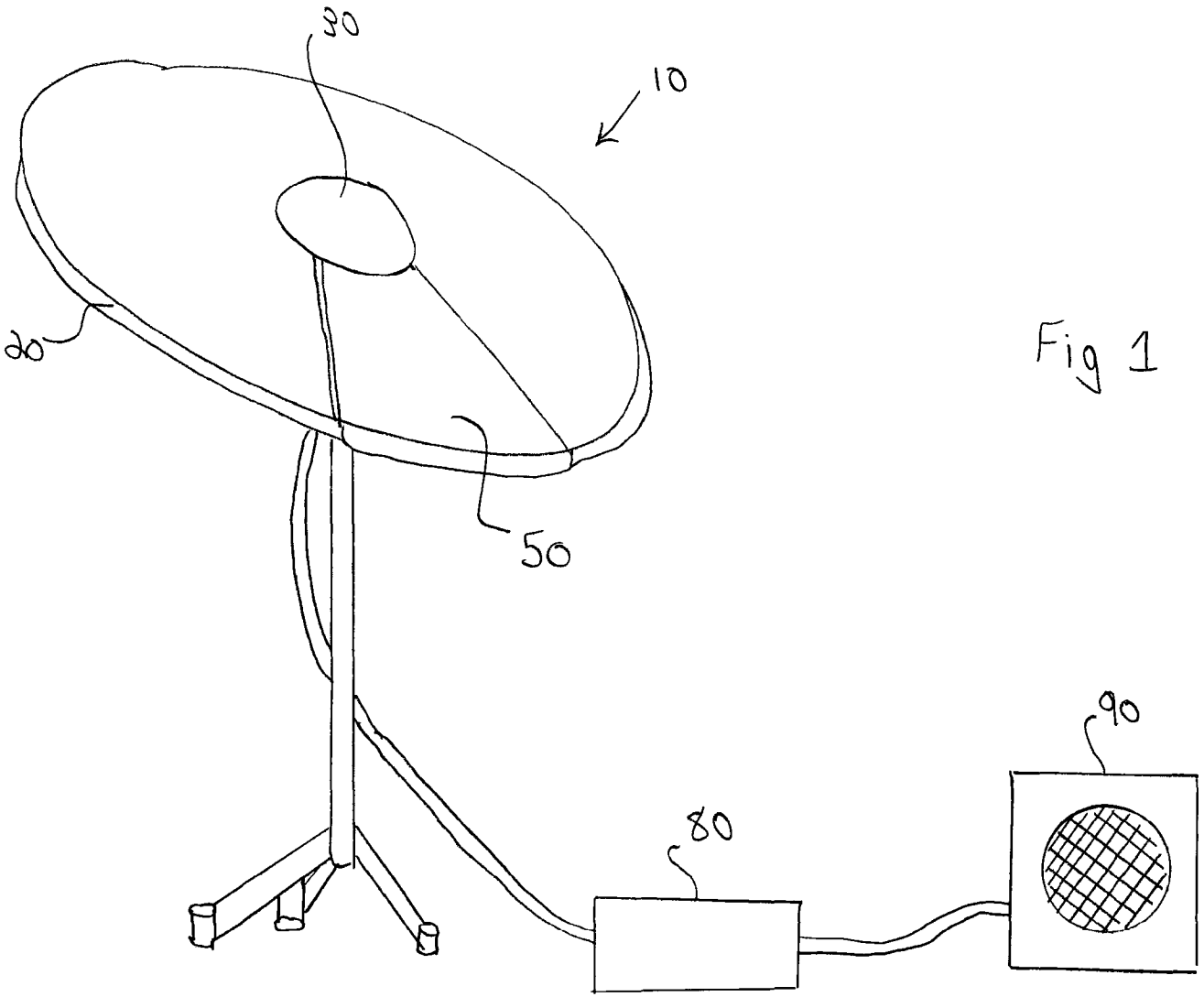
FIG. 1 is a perspective view of an illuminated cymbal.
Figure 2:
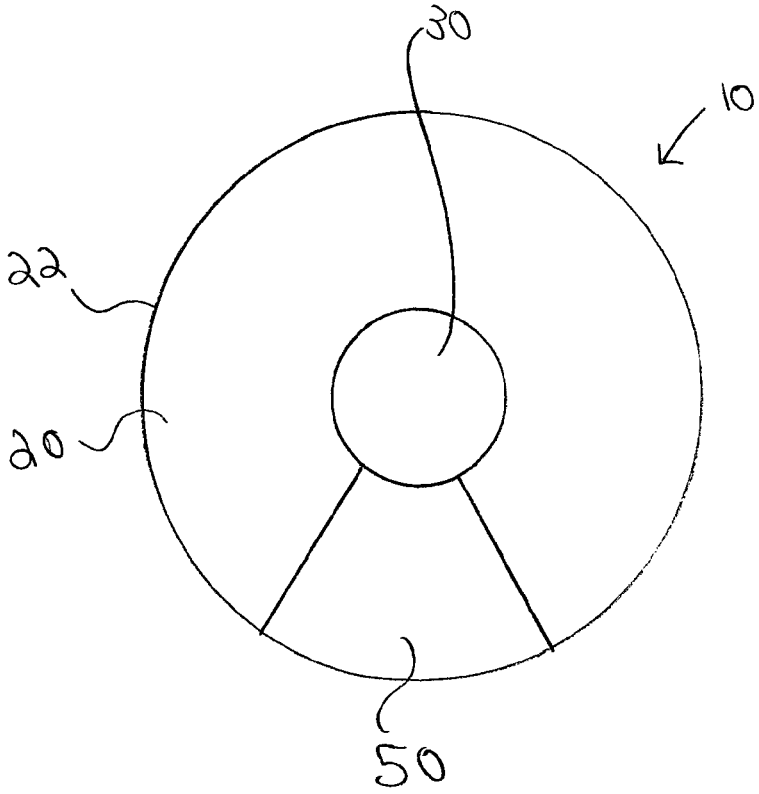
FIG. 2 is a top plan view of the illuminated cymbal.
Figure 3:
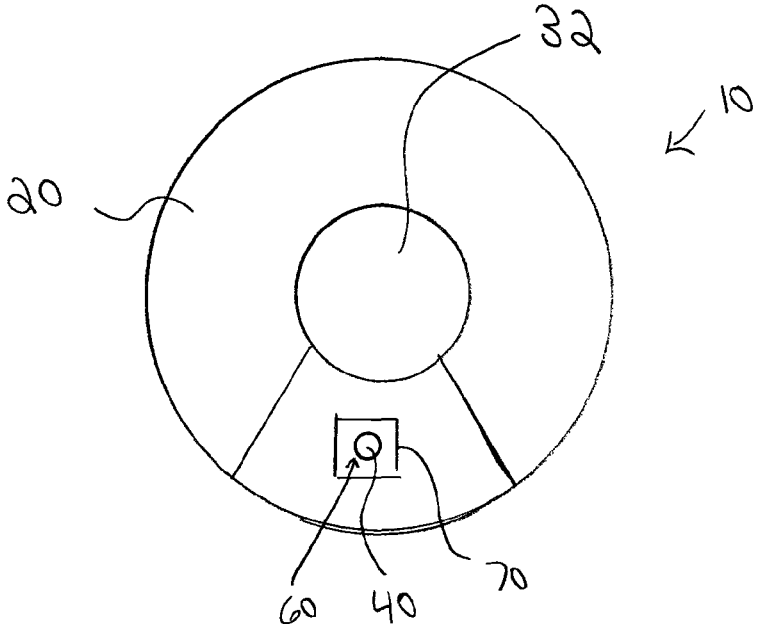
FIG. 3 is a bottom plan view of the illuminated cymbal.

The present invention provides an electronic cymbal system. Existing electronic cymbal systems work by having the musician strike the cymbal. A striking pad sensor mounted to the cymbal then detects that the cymbal has been struck, and sends an electronic signal to a musical controller and then to a speaker to produce an acoustic affect. There are many advantages to electronic cymbal systems. First, since the body of the cymbal does not vibrate and acoustically produce the sound itself, the cymbal designer has the ability to make the cymbal out of different materials (and also vary the shape of the cymbal somewhat from a traditional acoustic cymbal design). Second, a wide variety of musical sounds can be generated by electronic cymbals. This is due to the fact that it is the electronic musical controller actually generates the sound. Thus, striking the cymbal could be used to generate a traditional acoustic cymbal sound, the sound of another instrument, the sound of a voice, or other electronically generated sounds.

In accordance with the present novel invention, the cymbal system is illuminated. This has many advantages. Most notably, the present invention provides a visually entertaining aspect to a musical presentation. In various aspects, the cymbal may be illuminated continuously, or it may be illuminated only when struck. Similarly, it may be illuminated constantly with only one color, or with changing colors, or with changing intensities of one or more colors. Moreover, the cymbal may be continuously illuminated with a first color, and then periodically illuminated with other color(s) when struck. The possibilities are endless, and are limited only by the imagination of the person (or computer) operating the musical controller that is electronically connected to the cymbal.

As seen in the attached Figs., the present invention provides an illuminated cymbal 10, comprising: a light transmitting cymbal body 20; top and bottom coverings (30 and 32) on opposite sides of portions of cymbal body 20; a light source 40 mounted to emit light into cymbal body 20, wherein light source 40 is positioned such that the light is reflected between top and bottom coverings 30 and 32 to reflect radially outwards through cymbal body 20 to illuminate cymbal body 20; and a striking sensor pad 50 mounted adjacent to cymbal body 20.

When cymbal body 20 is transparent, the light will be reflected radially outwards through the cymbal body to illuminate outer edge 22 of cymbal body 20. Persons viewing the cymbal being played will thus see a brightly illuminated ring at outer edge 22 of cymbal body 20. In this aspect, the transparent illuminated cymbal body 20 may be made of acrylic. In other designs, illuminated cymbal body 20 may instead be translucent, for example by being made of acrylic with frosted outer edges. As such, the entire body 20 may be illuminated such that persons viewing the cymbal see a brightly illuminated disk when the cymbal is played.

Light source 40 may preferably be an LED (light emitting diode) light. Advantages of using an LED light source include its high brightness, and low wattage. In addition, LED light sources have the advantage of being easily controlled to vary between emitting different colors, and/or different lighting intensities. Furthermore, when more than one cymbal is being used, different cymbals can display different colors, adding to the affect of the visual presentation.

Figure 4:
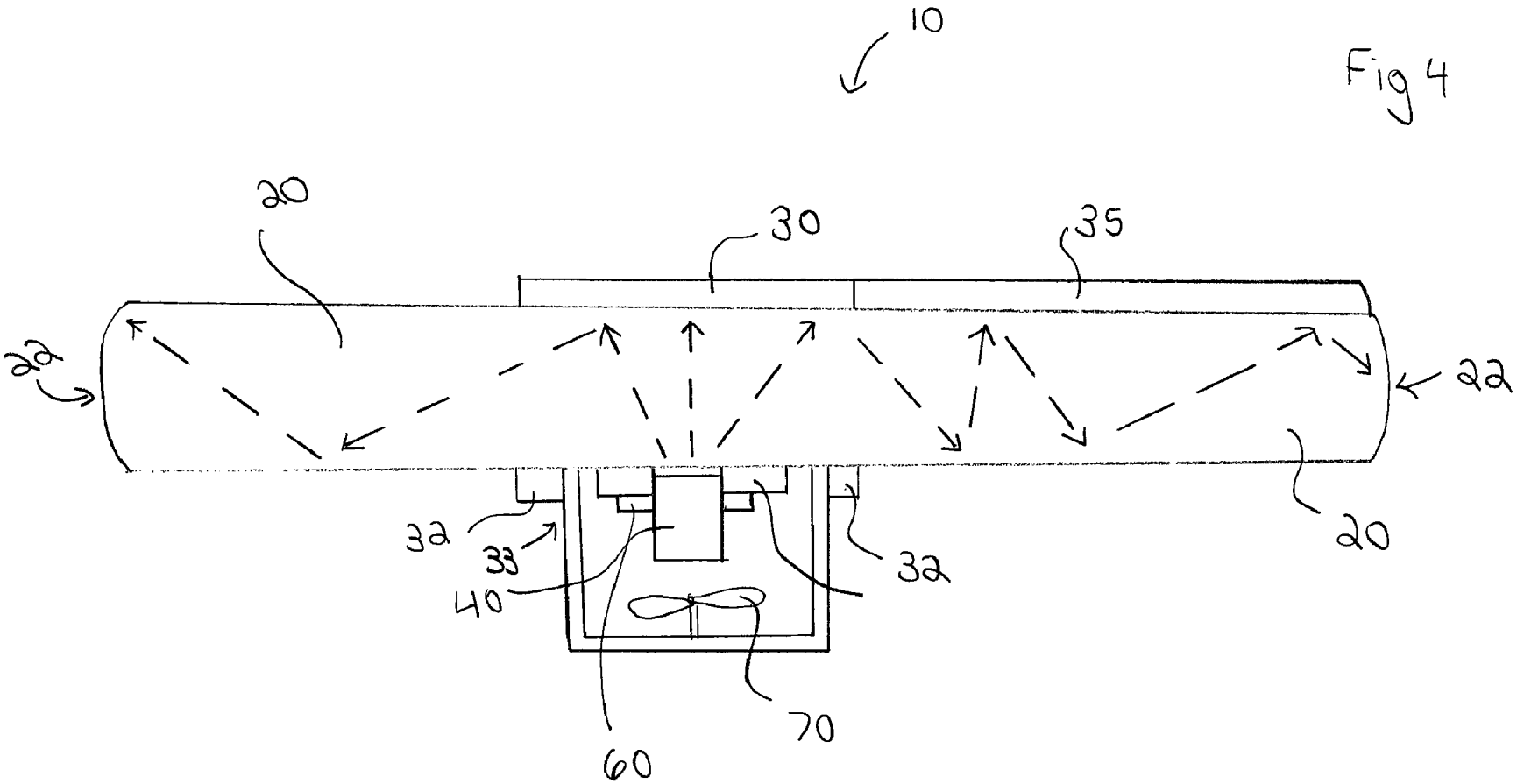
FIG. 4 is a side elevation sectional view of the illuminated cymbal.

Light source 40 may be mounted into bottom covering 32, passing through a hole 33 in bottom covering 32. Light from light source 40 is passes through cymbal body 20 and is then reflected off of top covering 30. As seen by dotted lines in FIG. 4, the light is reflected back and forth between top and bottom covers 30 and 32, radially outwardly towards outer edge 22 of cymbal body 20. This causes outer edge 22 of cymbal body 20 to become brightly illuminated (when cymbal body 20 is transparent). This bright illumination of outer edge 22 can be enhanced by making edge 22 rough, abraded or "cloudy" (which assists in scattering the light). Preferably, light source 40 is mounted perpendicular to the bottom or top edge of cymbal body 20, as shown. In one embodiment, light source 40 is mounted to a heat sink 60. In addition, one or more fans 70 may also be mounted onto bottom cover 32 to keep light source 40 cool by cooling heat sink 60.

A striking sensor pad 50 may be mounted directly onto the top of the light transmitting cymbal body 20, as shown. As can be seen, striking sensor pad 50 preferably covers only a portion of cymbal body 20. The top of striking sensor pad 50 is the location where the drummer hits the cymbal. Striking sensor pad 50 functions to protect the surface of cymbal body 20.

As seen in FIG. 1, when the drummer hits striking sensor pad 50, this impact is picked up by the sensor which in turn generates a signal that is sent to musical controller 80 (which may be a MIDI (Musical Instrument Digital Interface) or MIDI-type controller. The signal generated by controller 80 is then sent to speaker 90 where it produces an audible sound.

What is claimed:

1. An illuminated cymbal, comprising:

a light transmitting cymbal body;

top and bottom coverings on opposite sides of portions of the cymbal body;

a light source mounted to emit light into the cymbal body, wherein the light source is positioned such that the light is reflected between the top and bottom coverings to reflect radially outwards through the cymbal body to illuminate the cymbal body; and a striking sensor pad mounted on top of the cymbal body.

2. The illuminated cymbal of claim 1, wherein the light is reflected radially outwards through the cymbal body to illuminate an outer edge of the cymbal body.

3. The illuminated cymbal of claim 1, wherein the light transmitting cymbal body is transparent.

4. The illuminated cymbal of claim 1, wherein the light transmitting cymbal body is translucent.

5. The illuminated cymbal of claim 1, wherein the light source is an LED.

6. The illuminated cymbal of claim 1, wherein the light source is connected onto the bottom covering.

7. The illuminated cymbal of claim 1, wherein the cymbal body is made of acrylic.

8. The illuminated cymbal of claim 1, wherein the light source is mounted perpendicular to the bottom or top edge of the cymbal body.

9. The illuminated cymbal of claim 1, wherein the light source is mounted through the bottom covering on the cymbal body.

10. The illuminated cymbal of claim 1, further comprising:

at least one fan mounted to the bottom covering on the cymbal body for cooling the light source.

* * * * *